US007207743B2

(12) United States Patent
Polivka, Jr.

(10) Patent No.: US 7,207,743 B2
(45) Date of Patent: Apr. 24, 2007

(54) METHOD AND APPARATUS FOR CONSTRUCTING AN AUTOMOTIVE VEHICLE PARKING LOT

(75) Inventor: A. Basil Polivka, Jr., Warren, OH (US)

(73) Assignee: Polivka Parking Solutions LLC, Warren, OH (US)

( * ) Notice: Subject to any disclaimer, the term of this patent is extended or adjusted under 35 U.S.C. 154(b) by 0 days.

(21) Appl. No.: 10/417,831

(22) Filed: Apr. 17, 2003

(65) Prior Publication Data

US 2003/0223815 A1 Dec. 4, 2003

Related U.S. Application Data

(63) Continuation-in-part of application No. 10/156,371, filed on May 28, 2002, now Pat. No. 6,666,617.

(51) Int. Cl.
*E02D 3/00* (2006.01)
*E01C 5/00* (2006.01)
*E01C 5/22* (2006.01)

(52) U.S. Cl. ..... 404/73; 404/76; 405/258.1

(58) Field of Classification Search ..... 405/258.1, 405/19, 21, 270, 151, 20; 428/137; 404/73, 404/27–31, 36, 70, 75, 76
See application file for complete search history.

(56) References Cited

U.S. PATENT DOCUMENTS 3,346,219 A 10/1967 Salyer et al.
4,472,086 A 9/1984 Leach
4,800,119 A * 1/1989 Kolar ..... 442/373
4,806,043 A * 2/1989 Fournier ..... 404/2
4,865,899 A * 9/1989 Reichert ..... 428/189
4,896,993 A 1/1990 Bohnhoff
5,056,960 A * 10/1991 Marienfeld ..... 405/270
5,254,661 A * 10/1993 Wilson ..... 428/57
5,273,373 A 12/1993 Pouyer
5,288,165 A 2/1994 Douwes Dekker (Continued)

FOREIGN PATENT DOCUMENTS

WO WO 01/73205 A1 * 10/2001

*Primary Examiner*—Raymond Addie
(74) *Attorney, Agent, or Firm*—Tarolli, Sundheim, Covell, & Tummino L.L.P.

(57) ABSTRACT

A method for constructing an automotive vehicle parking lot (10) on a land area (12) is provided. A composite drainage material (20) is provided through which water drains. The composite drainage material (20) comprises a polymeric open mesh core (22) between first and second layers (24 and 26) of a non-woven geo-textile fabric. The land area (12) is covered with the material (20) by placing rolls (28) of the material adjacent one another. The rolls (28) are unrolled over the land area (12) so that longitudinal edge portions (30 and 40) of adjacent rolls adjoin one another. A portion (34, 44) of the longitudinal edge portions (30 and 40) are overlapped and secured to each other, and not to the land area (12), to create a gapless and continuous surface (84) of the material (20), with the majority of the land area (12) lying underneath the material. The first layer (24) of each of the rolls (28) contacts the land area (12). The second layer (26) of each of the rolls (28) faces away from the land area (28) and provides the surface (84) on which vehicles are parked.

9 Claims, 12 Drawing Sheets

U.S. PATENT DOCUMENTS

| | | | | |
|---|---|---|---|---|
| 5,326,192 | A | 7/1994 | Freed | |
| 5,377,447 | A | 1/1995 | Fritch | |
| 5,527,128 | A | 6/1996 | Rope et al. | |
| 5,720,135 | A | 2/1998 | Paquette | |
| 5,833,401 | A | 11/1998 | Olson | |
| 6,053,662 | A | 4/2000 | Scuero | |
| 6,258,430 | B1 | 7/2001 | Perlman | |
| 6,361,245 | B1 | 3/2002 | Polivka | |
| 6,481,934 | B1 | 11/2002 | Alexiew | |
| 6,505,996 | B1 * | 1/2003 | Ianniello et al. | 405/36 |
| 6,518,208 | B2 * | 2/2003 | Terakawa | 442/327 |
| 2003/0178122 | A1 * | 9/2003 | Ianniello et al. | 156/71 |
| 2003/0224143 | A1 * | 12/2003 | Ianniello et al. | 428/137 |

* cited by examiner

METHOD AND APPARATUS FOR CONSTRUCTING AN AUTOMOTIVE VEHICLE PARKING LOT

CROSS REFERENCE TO RELATED APPLICATION

This application is a continuation-in-part of U.S. patent application Ser. No. 10/156,371, which was filed on May 28, 2002 now U.S. Pat. No. 6,666,617.

TECHNICAL FIELD

The present invention is directed to a method and apparatus for constructing an automotive vehicle parking lot on a land area.

BACKGROUND OF THE INVENTION

The transportation industry often requires additional parking areas for temporary automotive vehicle storage prior to vehicle transfer and/or distribution. Such parking areas are typically needed adjacent rail yards and automotive production facilities. These additional parking areas are sometimes only needed for a relatively short period of time, such as two or three months, but can also be used for up to five years. Regardless, it is desirable to minimize the time and expenses associated with constructing the additional parking areas.

Traditionally, automotive vehicle parking lots are constructed by covering a land area with concrete or asphalt. These traditional construction methods provide a desirable hard surface for automotive vehicles to be driven on, but are time-consuming and expensive. Further, covering the land area with concrete or asphalt can create complications in the project, such as having to construct a retention pond to deal with excess rain water.

Other less permanent methods for constructing automotive vehicle parking lots are also known. These other methods include covering a land area with gravel, wood chips, or shredded rubber from recycled tires. These non-traditional methods reduce the time and expenses associated with constructing the parking areas. However, these methods do not provide the desired parking surface, and can lead to the automotive vehicles being damaged. Such automotive vehicle damage can range from scratches in a vehicle's paint to extensive body damage caused by vehicles sliding into one another when excessive rain washes away the gravel, wood chips, or shredded rubber, and turns at least a portion of the parking area into a mud pit.

SUMMARY OF THE INVENTION

The present invention provides a method of constructing an automotive vehicle parking lot on a land area. According to the inventive method, a composite drainage material is provided through which water drains. The composite drainage material comprises a polymeric open mesh core between first and second layers of a non-woven geo-textile fabric. The land area is covered with the composite drainage material by placing rolls of the composite drainage material adjacent one another to form the temporary automotive parking lot. The rolls of the composite drainage material are unrolled over the land area so that longitudinal edge portions of adjacent rolls adjoin one another. A portion of the longitudinal edge portions of the adjacent rolls are overlapped. The overlapped portions of the longitudinal edge portions of adjacent rolls are secured to each other by heat-fusing sections of the overlapped portions to create a gapless and continuous surface of the composite drainage material with at least the majority of the land area lying underneath the composite drainage material. The first layer of each of the rolls contacts the land area. The second layer of each of the rolls faces away from the land area and provides the gapless and continuous surface on which automotive vehicles are parked. The composite drainage material directs water which contacts the second layer through the first layer, through the core between the layers, and into the land area covered by the composite drainage material.

According to one aspect of the inventive method, the step of overlapping a portion of the longitudinal edge portions comprises overlapping a flap section of the second layer that extends beyond the cone.

According to another aspect of the inventive method, the step of securing the overlapped portions of the adjacent rolls comprises the step of heat-fusing the overlapped flap section of the second layer to the second layer on the adjacent roll.

According to another aspect of the inventive method, the composite drainage material further includes a polymeric upper layer attached on top of the second layer, and the step of overlapping a portion of the longitudinal edge portions comprises overlapping a flap section of the upper layer that extends beyond the second layer.

According to another aspect of the inventive method, the step of securing the overlapped portions of the adjacent rolls comprises the step of heat-fusing the flap section of the upper layer to the upper layer on an adjacent roll.

According to another aspect of the inventive method, the step of securing the overlapped portions to each other by heat-fusing comprises the steps of placing a polymeric filler rod on the overlapping positions and heat-fusing the overlapped portions together by melting the filler rod.

According to still another aspect of the inventive method, peripheral sections of a portion of the rolls of the composite drainage material are anchored to the land area by burying the peripheral sections under ground. The buried peripheral sections are covered with the edge portions of adjacent rolls.

According to still yet another aspect of the inventive method, the step of anchoring peripheral sections to the land area includes digging trenches in the land area underneath the peripheral sections, placing the peripheral sections into the trenches, so that the peripheral sections form a lining inside the trenches, and filling the trenches lined by the peripheral sections with material previously removed during said step of digging to thereby anchor the peripheral sections to the land area.

The present invention further provides a method of constructing an automotive vehicle parking lot system for a plurality of automotive vehicles on a land area. According to this inventive method, a land area is provided. Predetermined portions of the land area are prepared for installation of a main drive and a plurality of drive lanes branching from the main drive that provide a path for the vehicles to follow when being parked. Predetermined amounts of land area are excavated along a predetermined distance at a plurality of locations within a periphery of the land area where the main drive and drive lines are to be located. A layer of non-woven geo-textile filter fabric is installed over the excavated land area. A predetermined amount of gravel is installed over the filter fabric. The gravel is compacted. Rolls of a composite drainage material, through which water drains, are laid on top of the land area including over the main drive and the drive lanes to create a gapless and continuous surface on which the vehicles navigate and are parked. A portion of the composite drainage material is overlapped at longitudinal edge portions of adjacent rolls. The overlapped portions of the longitudinal edge portions are secured to each other.

According to another aspect of the inventive method, the step of laying rolls of a composite drainage material through which water drains on top of the land area to create a gapless and continuous surface includes excavating a portion of the land area to create anchor trenches around a periphery of the land area, unrolling the rolls of the composite drainage material over the land area so that at least one of the longitudinal edge portions of the rolls is at least partially inside the trenches, and filling the trenches containing the edge portions of the rolls with the excavated land to anchor the edge portions to the land area.

According to another aspect of the inventive method, the step of securing the overlapped portions of the longitudinal edge portions of adjacent rolls to each other includes excavating portions of the land area to create additional anchor trenches within the periphery of the land area, placing at least a portion of the longitudinal edges of the rolls of the composite drainage material adjacent the additional trenches so that at least one of the longitudinal edge portions of the rolls are at least partially inside the additional trenches, and filling the additional trenches containing the at least some of the plurality of edges of the rolls with the excavated land to anchor the edges to the land area.

The present invention also provides an automotive vehicle parking lot for a plurality of automotive vehicles on a land area. The parking lot comprises a plurality of separate rolls of a composite drainage material placed adjacent each other with longitudinal edge portions adjoining and overlapping one another and which are secured together to create a gapless and continuous surface with at least the majority of the land area lying underneath the composite drainage material. The composite drainage material comprises a layer of a polymeric open mesh core between first and second layers of a non-woven geo-textile fabric. A plurality of parking spaces are provided for the plurality of vehicles. The parking spaces are arranged around a main drive which bisects the parking lot and a plurality of drive lanes intersect the main drive. The main drive and the drive lanes comprise predetermined drive paths along the composite drainage material for vehicles to follow when being parked. Underneath the composite drainage material at the location of the main drive comprises an area of the land excavated to a predetermined depth. An additional layer of non-woven geo-textile fabric is placed into the area of the land excavated. A layer of stones is installed on top of the additional layer of non-woven geo-textile fabric.

In accordance with one aspect of the invention, underneath the composite drainage material at the location of each drive lane, an area of the land is excavated to a predetermined depth. An additional layer of non-woven geo-textile fabric is placed into the area of the land excavated, and a layer of stones is located on top of the additional layer of non-woven geo-textile fabric.

In accordance with another aspect of the invention, at least a portion of the plurality of rolls of the composite drainage material are anchored to the land area by burying edge sections of the rolls underneath a predetermined amount of land.

In accordance with another aspect of the invention, the edge sections of the rolls are anchored to the land at an outer periphery of the parking lot.

In accordance with another aspect of the invention, the edge sections of the rolls are anchored to the land at areas distributed inside of an outer periphery of the parking lot.

In accordance with another aspect of the invention, the anchored rolls located inside of the outer periphery of the parking lot are secured to each other by heat-fusing to an adjacent edge portion of a roll of composite drainage material not anchored to the land at a location of the anchored roll that is a predetermined distance from the buried edge of the anchored roll.

In accordance with another aspect of the invention, the composite drainage material further includes an upper layer of a perforated polymeric material that is heat-fused to the second layer.

BRIEF DESCRIPTION OF THE DRAWINGS

The foregoing and other features of the present invention will become apparent to those skilled in the art to which the present invention relates upon reading the following description with reference to the accompanying drawings, wherein.

DESCRIPTION OF EMBODIMENTS

Figure 1:
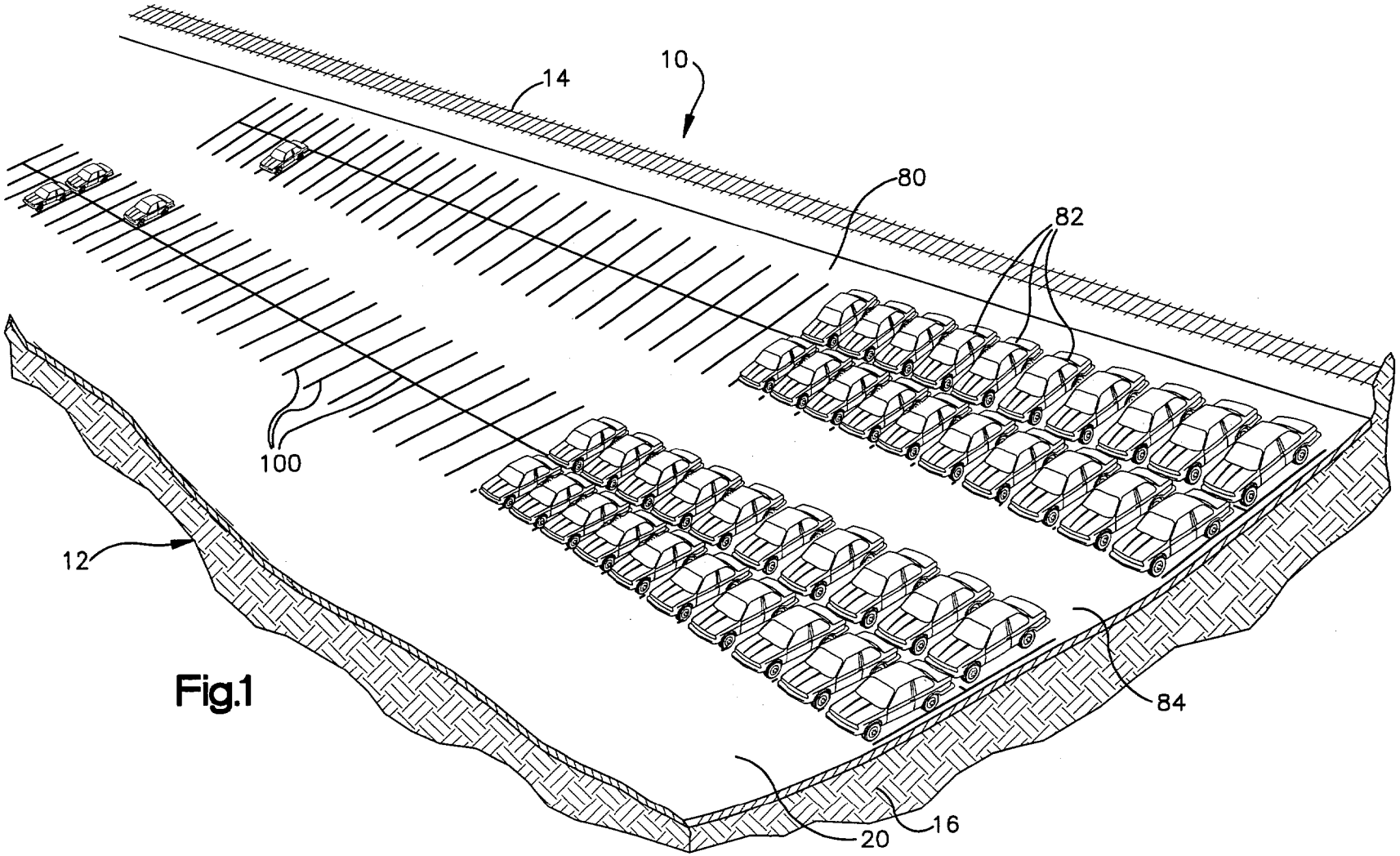
FIG. 1 is a schematic perspective view of a temporary automotive vehicle parking lot constructed in accordance with the present invention.

The present invention is directed to a method and apparatus for constructing an automotive vehicle parking lot on a land area. As representative of the present invention, FIG. 1 illustrates an automotive vehicle parking lot 10.

The parking lot 10 is situated on a land area 12 adjacent railroad tracks 14. The land area 12 has been cleared of any trees and large shrubbery. Thus, the land area 12 comprises soil 16 and has an upper surface 18 (FIG. 2) which may be covered by grass or other vegetation (not shown). Preferably, the land area 12 is relatively flat.

Figure 3:
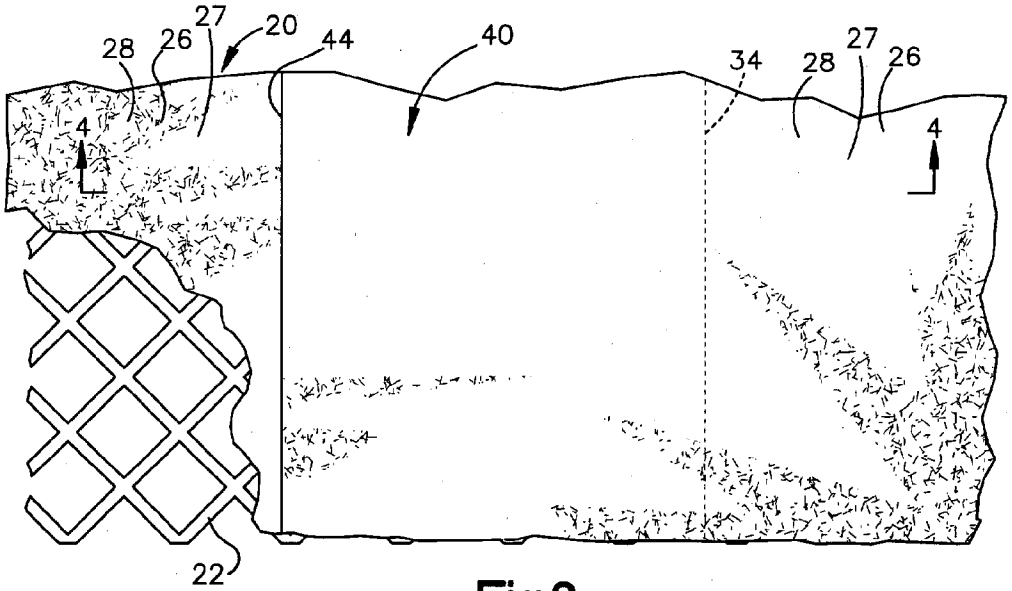
FIG. 3 is an enlarged plan view of a portion of the temporary automotive vehicle parking lot shown in FIG. 2 during construction.

A composite material 20 through which water can drain is used to construct the parking lot 10 on the land area 12. The composite drainage material 20 comprises a polymeric open mesh core 22 (FIG. 3) between first and second layers 24 and 26 (FIG. 4) of a non-woven geo-textile fabric. The core 22 is 2–8 mm thick and is extruded from polyethylene resin.

The geo-textile fabric used for the first and second layers 24 and 26 is a continuous layer of a polypropylene material with an additive to help protect the fabric from the effects of ultraviolet light. The first and second layers 24 and 26 are water permeable, but are sufficiently dense to prevent solid matter, such as soil, from penetrating through the layers. Each of the first and second layers 24 and 26 is 2–8 mm thick.

The polyethylene core 22 is placed between the first and second layers 24 and 26 and the composite drainage material 20 is laminated using a heating process. The heating process fuses both the first and second layers 24 and 26 of the fabric to the core 22 to create the composite drainage material 20. While central portions 25 and 27 (constituting the vast majority) of the first and second layers 24 and 26, respectively, are fused to the core 22, along the outer periphery of the composite drainage material 20, the first and second layers are not fused to the core, as is described further below.

Figure 2:
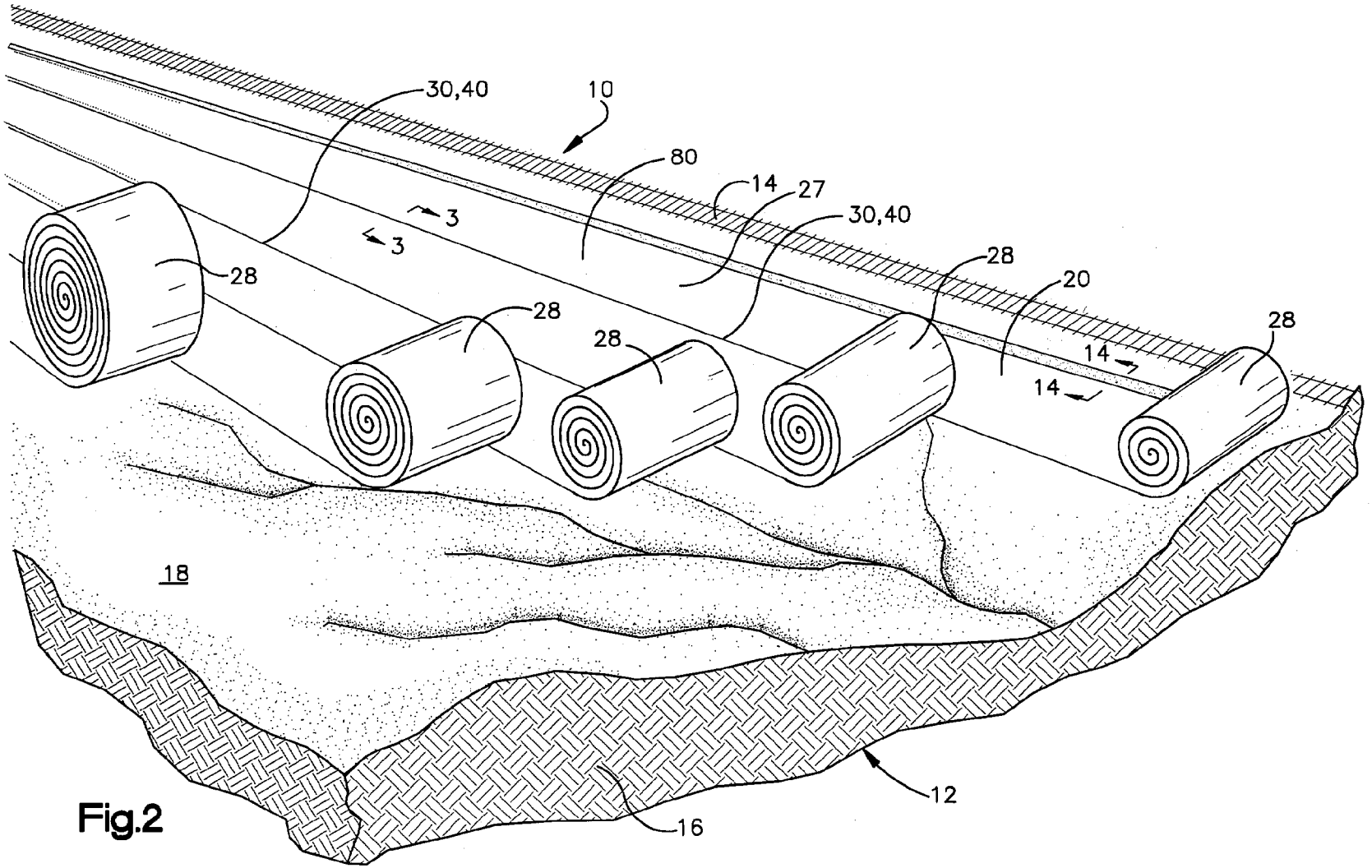
FIG. 2 is a schematic perspective view of the temporary automotive vehicle parking lot of FIG. 1 during its construction.
Figure 4:
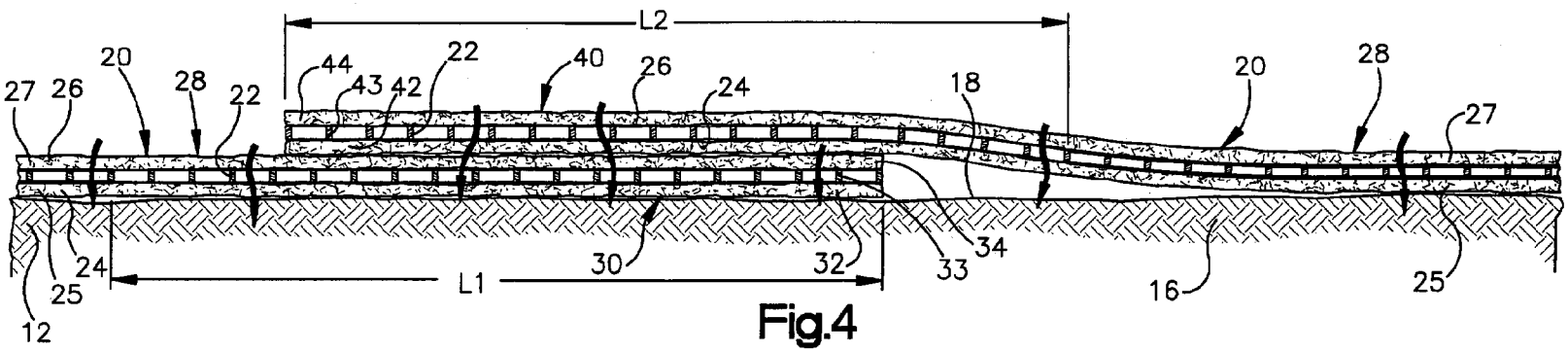
FIG. 4 is a sectional view taken along line 4—4 in FIG. 3.

The composite drainage material 20 is formed in rolls, as shown in FIG. 2, for ease of shipping and installation. The composite drainage material 20 may be 7 to 12 feet wide, and up to 250 feet long when unrolled. Each roll 28 of the composite drainage material 20 includes oppositely disposed first and second longitudinal edges 30 and 40 (FIG. 4).

The first longitudinal edge 30 is formed by an edge portion 32 of the first layer 24, an edge portion 33 of the core 22, and an edge portion 34 of the second layer 26. As may be seen in FIG. 4, the edge portions 32–34 are flush with one another and are not fused together. The unfused first longitudinal edge 30 extends inward for a length L1 of 6 to 10 inches to the fused central portion 27 of each roll 28.

The second longitudinal edge 40 is formed by an edge portion 42 of the first layer 24, an edge portion 43 of the core 22, and an edge portion 44 of the second layer 26. As may be seen in FIG. 4, the edge portions 42–44 are flush with one another. The unfused second longitudinal edge 40 extends inward for a length L2 of 6 to 10 inches to the fused central portions 25 and 27 of each roll 28.

To construct the parking lot 10, several rolls 28 of the composite drainage material 20 are placed on the land area 12 adjacent one another. The rolls 28 of the composite drainage material 20 are then unrolled, as illustrated in FIG. 2, so that the first longitudinal edge 30 of one roll of the composite drainage material adjoins and overlaps, as described further below, the second longitudinal edge 40 of an adjacent roll of the composite drainage material. The first fabric layer 24 of each roll 28 of the composite drainage material 20 contacts the upper surface 18 of the land area 12. The second fabric layer 26 of each roll 28 faces upward, away from the land area 12, and provides a surface 80 on which automotive vehicles 82 (FIG. 1) may be parked.

Figure 5:
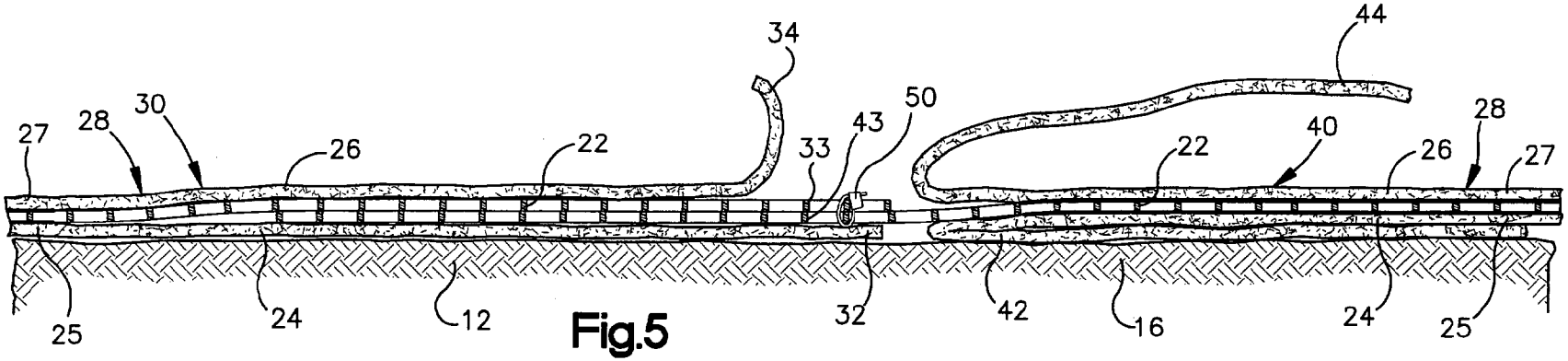
FIG. 5 is a sectional view similar to FIG. 4 illustrating a step in the construction of the temporary automotive vehicle parking lot.

As best seen in FIG. 4, the adjoining first and second longitudinal edges 30 and 40 of adjacent rolls 28 are unrolled so that the second longitudinal edge overlaps the first longitudinal edge. Next, the first and second layers 24 and 26 of the second longitudinal edge 40 are pulled back, as shown in FIG. 5, exposing the core 22. More specifically, the edge portion 42 of the first layer 24 of the second longitudinal edge 40 is folded back underneath itself over the land area 12, and the edge portion 44 of the second layer 26 of the second longitudinal edge is pulled back to expose the edge portion 43 of the core 22. The edge portion 34 of the second layer 26 of the first longitudinal edge 30 is also pulled back as shown in FIG. 5.

The edge portion 43 of the core 22 of the second longitudinal edge 40 is then inserted between the edge portion 33 of the core 22 and the edge portion 32 of the first layer 24 of the first longitudinal edge 30. As may be seen in FIG. 5, there is approximately 4 to 8 inches of overlap between the edge portions 33 and 43 of the cores 22.

Next, the edge portion 43 of the core 22 of the second longitudinal edge 40 is secured to the edge portion 33 of the core 22. The edge portions 33 and 43 of the cores 22 are secured together by looping a plurality of tie members 50, only one of which is shown in FIG. 5, through the edge portions 33 and 43 and tightening. The tie members 50 may be of any known construction and made of either a plastic or a metal. The tie members 50 are then tightened to draw the edge portions 33 and 34 together and thereby secure the longitudinal edges 30 and 40 to each other.

Figure 6:
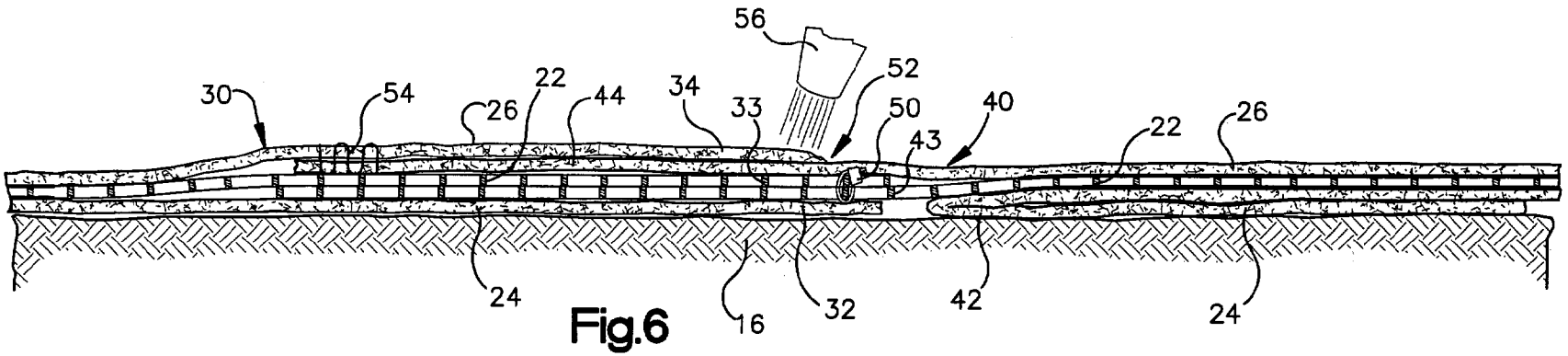
FIG. 6 is a sectional view similar to FIG. 5 illustrating another step in the construction of the temporary automotive vehicle parking lot.

The next step is to secure the second layer 26 of the two adjoining rolls 28 to each other and form a seam 52 that extends along the longitudinal edges 30 and 40. As shown in FIG. 6, the edge portion 44 of the second layer 26 along the second longitudinal edge 40 is laid down over the edge portion 33 of the core 22 of the first longitudinal edge 30. The edge portion 34 of the second layer 26 along the first longitudinal edge 30 is then unfolded and laid down on top of the edge portion 44 of the second layer 26 in an overlapping fashion.

Next, the edge portions 34 and 44 of the two second layers 26 are sewn together with stitches 54 at or near the terminal end of the edge portion 44. The stitches 54, which are shown schematically in FIG. 6, weave through the edge portions 34 and 44 of the two second layers 26 and extend along the entire longitudinal edge portions 30 and 40. The stitches 54 may be made of nylon or other suitable material and can have any known stitching pattern. Sewing of the stitches 54 is preferably done by machine.

The two second layers 26 are then heat-fused together to form the longitudinally extending seam 52. The edge portions 34 and 44 of the two second layers 26 are fused together near the terminal end of the edge portion 34 using a heat gun 56, a portion of which is shown schematically in FIG. 6. The seam 52 formed by the two second layers 26 extends along the entire longitudinal edge portions 30 and 40.

Figure 7:
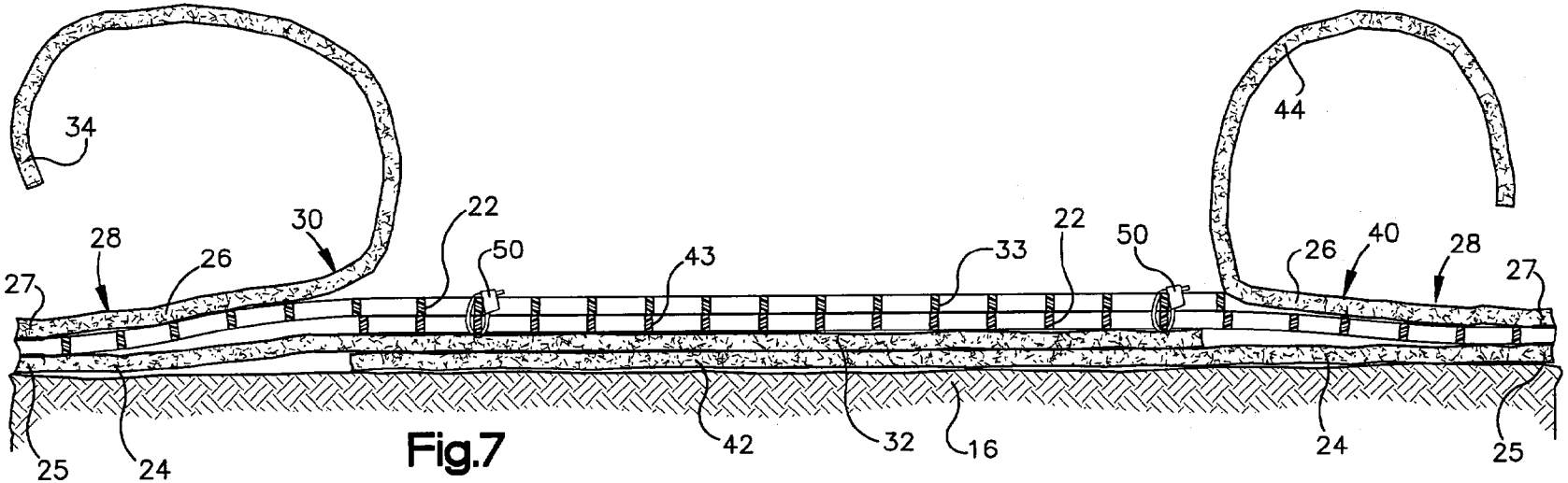
FIG. 7 is a sectional view similar to FIG. 5 illustrating a step for constructing a temporary automotive parking lot in accordance with a second method.
Figure 8:
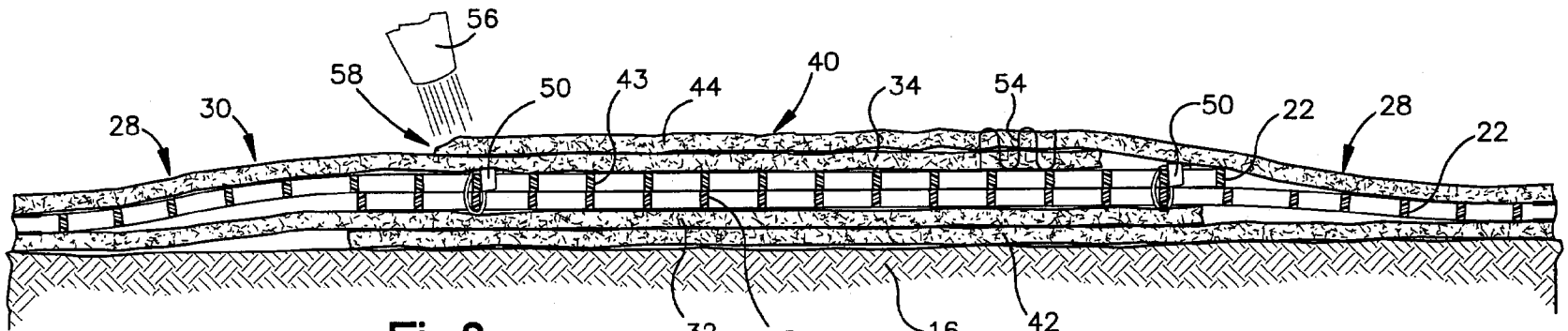
FIG. 8 is a sectional view illustrating another step for constructing the temporary automotive parking lot in accordance with the second method of FIG. 7.

A second method for joining the first and second longitudinal edges 30 and 40 of the adjacent rolls 28 is illustrated in FIGS. 7 and 8. In FIG. 7, it can be seen that the edge portion 44 of the second layer 26 of the second longitudinal edge 40 is pulled back to expose the edge portion 43 of the core 22. Similarly, the edge portion 34 of the second layer 26 of the first longitudinal edge 30 is also pulled back to expose the edge portion 33 of the core 22.

The edge portion 43 of the core 22 of the second longitudinal edge 40 is then inserted between the edge portion 33 of the core 22 and the edge portion 32 of the first layer 24 of the first longitudinal edge 30. As in the embodiment of FIGS. 1–6, there is approximately 4 to 8 inches of overlap between the edge portions 33 and 43 of the cores 22. As shown in FIG. 7, the edge portion 42 of the first layer 24 of the second longitudinal edge 40 is slid under the edge portion 32 of the first layer 24 of the first longitudinal edge 30.

Next, the edge portions 33 and 43 of the cores 22 are secured together by tie members 50, as described previously with regard to FIG. 5, through the edge portions 33 and 43. As shown in FIG. 7, there may be more than one row of the tie members 50 extending along the longitudinal edges 30 and 40 of the rolls 28.

The next step is to secure the second layer 26 of the two adjoining rolls 28 to each other and form a seam 58 that extends along the longitudinal edges 30 and 40. As shown in FIG. 8, the edge portion 34 of the second layer 26 along the first longitudinal edge 30 is laid down over the edge portion 33 of the core 22 of the first longitudinal edge 30. The edge portion 44 of the second layer 26 along the second longitudinal edge 40 is then unfolded and laid down on top of the edge portion 34 of the second layer 26 in an overlapping fashion.

The edge portions 34 and 44 of the two second layers 26 are sewn together with stitches 54 at or near the terminal end of the edge portion 34. The stitches 54, which are shown schematically in FIG. 8, weave through the edge portions 34 and 44 of the two second layers 26 and extend along the entire longitudinal edge portions 30 and 40. The stitches 54 may be made of nylon or other suitable material and can have any known stitching pattern. Sewing of the stitches 54 is preferably done by machine.

The two second layers 26 are then heat-fused together to form the longitudinally extending seam 58. The edge portions 34 and 44 of the two second layers 26 are fused together near the terminal end of the edge portion 44 using the heat gun 56, shown schematically in FIG. 8. The seam 58 formed by the two second layers 26 extends along the entire longitudinal edge portions 30 and 40.

Figure 9:
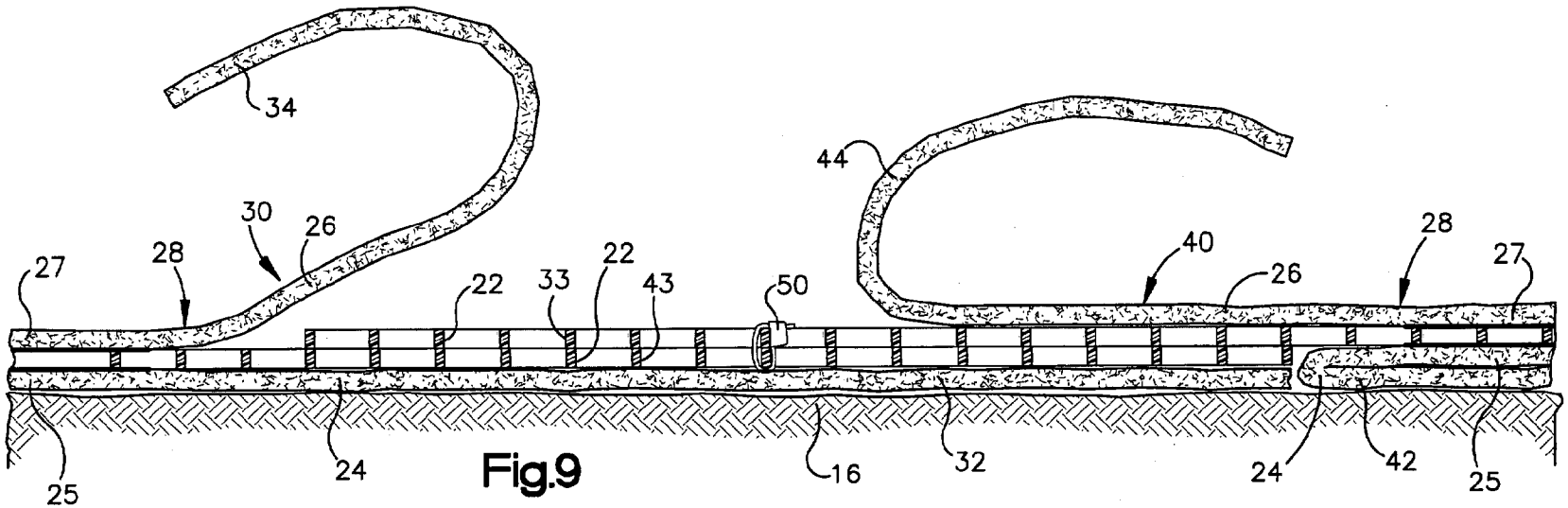
FIG. 9 is a sectional view similar to FIG. 5 illustrating a step for constructing a temporary automotive parking lot in accordance with a third method.
Figure 10:
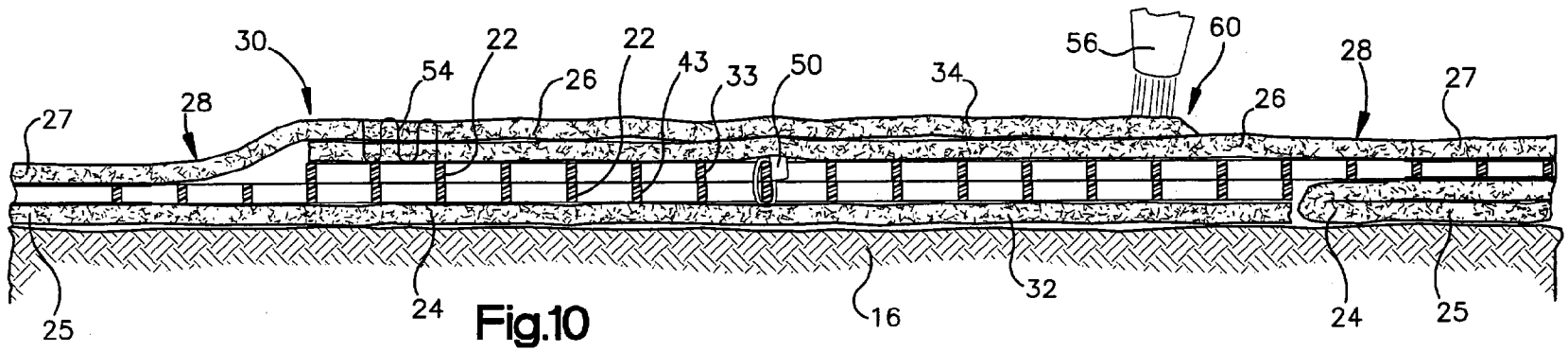
FIG. 10 is a sectional view illustrating another step for constructing the temporary automotive parking lot in accordance with the third method of FIG. 9.

A third method for joining the first and second longitudinal edges 30 and 40 of the adjacent rolls 28 is illustrated in FIGS. 9 and 10. In FIG. 9, it can be seen that the edge portion 44 of the second layer 26 of the second longitudinal edge 40 and the edge portion 42 of the first layer 24 of the second longitudinal edge are pulled back to expose the edge portion 43 of the core 22. The edge portion 34 of the second layer 26 of the first longitudinal edge 30 is also pulled back to expose the edge portion 33 of the core 22.

The edge portion 43 of the core 22 of the second longitudinal edge 40 is then placed on top of the edge portion 33 of the core 22 and the edge portion 32 of the first layer 24 of the first longitudinal edge 30. As in the embodiment of FIGS. 1–6, there is approximately 4 to 8 inches of overlap between the edge portions 33 and 43 of the cores 22. The edge portions 33 and 43 of the cores 22 are then secured together by tie members 50, as described previously with regard to FIG. 5, through the edge portions 33 and 43. It should be understood that there may be more than one row of the tie members 50 extending along the longitudinal edges 30 and 40 of the rolls 28.

The next step is to secure the second layer 26 of the two adjoining rolls 28 to each other and form a seam 60 that extends along the longitudinal edges 30 and 40. As shown in FIG. 10, the edge portion 44 of the second layer 26 along the second longitudinal edge 40 is laid down over the edge portion 33 of the core 22 of the second longitudinal edge. The edge portion 34 of the second layer 26 along the first longitudinal edge 30 is then laid down on top of the edge portion 44 of the second layer 26 in an overlapping fashion.

The edge portions 34 and 44 of the two second layers 26 are sewn together with stitches 54 at or near the terminal end of the edge portion 44. The stitches 54, which are shown schematically in FIG. 10, weave through the edge portions 34 and 44 of the two second layers 26 and extend along the entire longitudinal edge portions 30 and 40. The stitches 54 may be made of nylon or other suitable material and can have any known stitching pattern. Sewing of the stitches 54 is preferably done by machine.

The two second layers 26 are then heat-fused together to form the longitudinally extending seam 60. The edge portions 34 and 44 of the two second layers 26 are fused together near the terminal end of the edge portion 34 using the heat gun 56, shown schematically in FIG. 8. The seam 60 formed by the two second layers 26 extends along the entire longitudinal edge portions 30 and 40.

Figure 11:
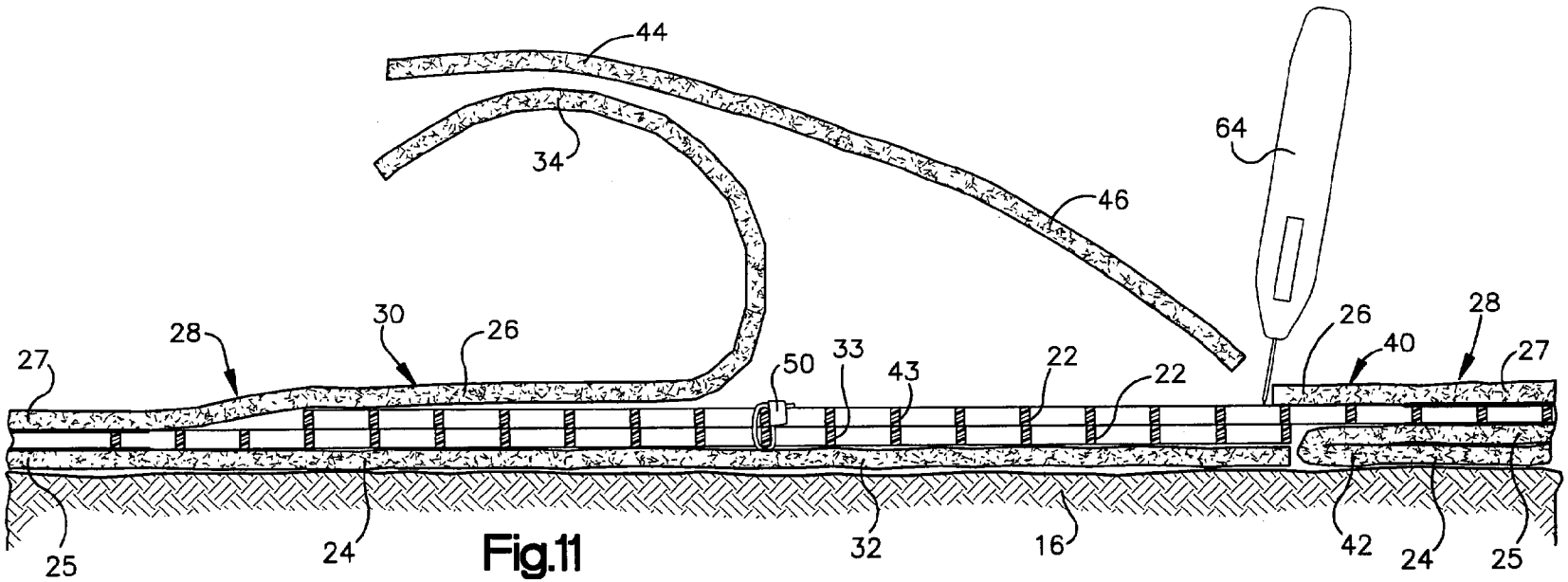
FIG. 11 is a sectional view similar to FIG. 5 illustrating a step for constructing a temporary automotive parking lot in accordance with an fourth method.
Figure 12:
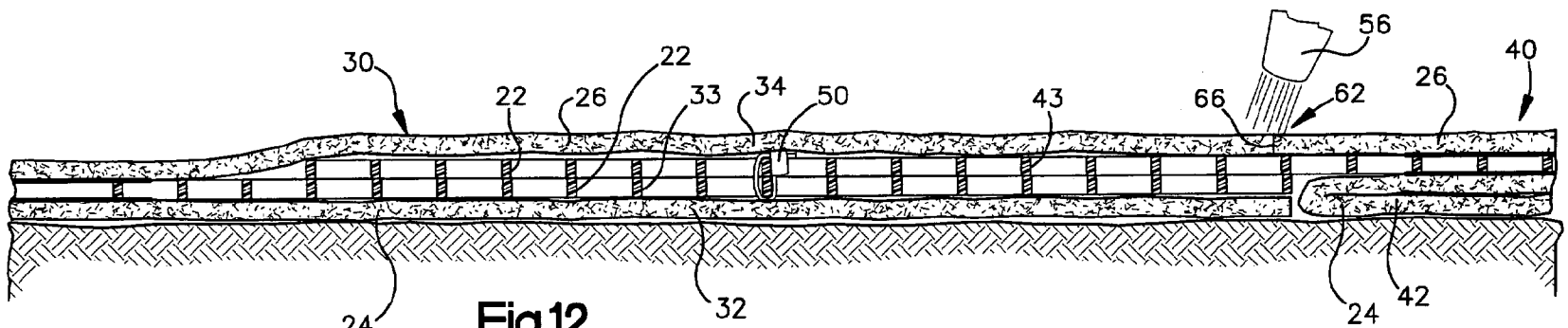
FIG. 12 is a sectional view illustrating another step for constructing the temporary automotive parking lot in accordance with the fourth method of FIG. 12.
Figure 13:
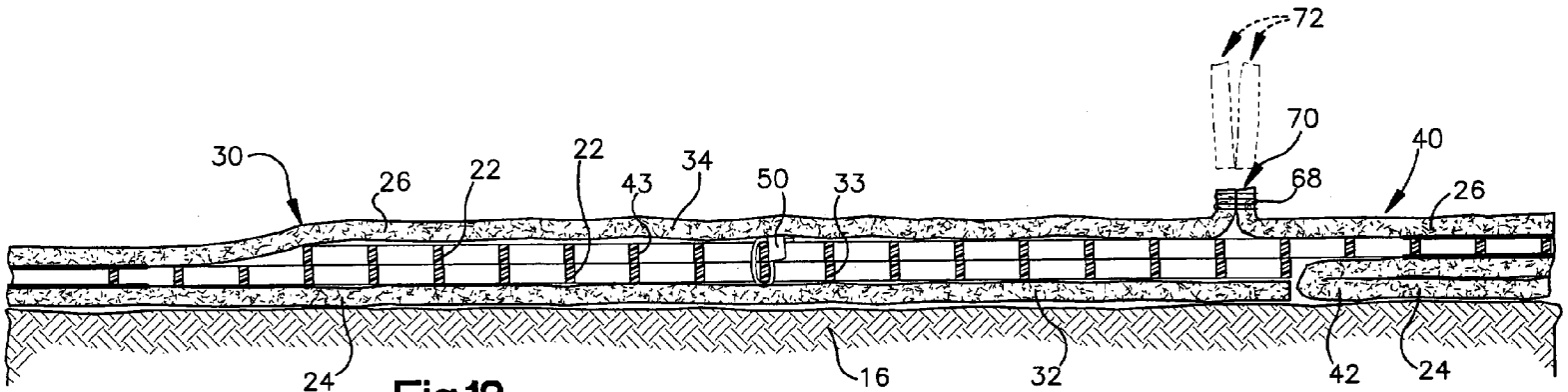
FIG. 13 is a sectional view similar to FIG. 12 illustrating an alternate step for constructing the temporary automotive vehicle parking lot in accordance with the fifth method.

Additional methods for securing the second layers 26 together along the longitudinal edges 30 and 40 and forming a seam are illustrated in FIGS. 11–13. In FIG. 11, the edge portion 44 of the second layer 26 of the second longitudinal edge 40 and the edge portion 42 of the first layer 24 of the second longitudinal edge are pulled back to expose the edge portion 43 of the core 22. The edge portion 34 of the second layer 26 of the first longitudinal edge 30 is also pulled back to expose the edge portion 33 of the core 22.

The edge portion 43 of the core 22 of the second longitudinal edge 40 is then inserted between the edge portion 33 of the core 22 and the edge portion 34 of the second layer 26 of the first longitudinal edge 30. The edge portion 43 of the core 22 overlaps the edge portion 33 of the core 22 over a distance of 4 to 8 inches.

Next, the edge portion 43 of the core 22 of the second longitudinal edge 40 is secured to the edge portion 33 of the core 22. The edge portions 33 and 43 of the cores 22 are secured together by looping a plurality of tie members 50, only one of which is shown in FIG. 11, through the edge portions 33 and 34 and tightening. The tie members 50 are then tightened to draw the edge portions 33 and 34 together and thereby secure the longitudinal edge 30 and 40 to each other.

The next step is to secure the second layer 26 of the two adjoining rolls 28 to each other and form a seam 62 that extends along the longitudinal edges 30 and 40. This may be done in a couple of different manners. One process for securing the two second layers 26 together is illustrated in FIGS. 11 and 12. As shown in FIG. 11, an end section 46 of the edge portion 44 of the second longitudinal edge 40 is trimmed off using a sharp blade or utility knife 64. The end section 46 is trimmed off at a location such that, when the edge portion 34 of the first longitudinal edge 30 is unfolded and laid down next to the now-cut edge portion 44, a butt joint 66 (FIG. 12) is created between the second layer 26 of the first longitudinal edge and the second layer 26 of the second longitudinal edge 40. The two second layers 26 are then heat-fused together along the butt joint 66 of the adjoining edge portions 34 and 44 to form the longitudinally extending seam 62.

An alternate method for securing the second layers 26 together along the longitudinal edges 30 and 40 and forming a seam is illustrated in FIG. 13. In FIG. 13, the edge portion 34 of the first longitudinal edge 30 and the edge portion 44 of the second longitudinal edge 40 are brought together in an abutting fashion. The edge portions 34 and 44 are then sewn together using stitches 68, such as the stitches previously described, to form a longitudinally extending seam 70. Depending on their size, excess sections 72 of the edge portions 34 and 44 that extend beyond the stitching may either be trimmed off or left attached to the edge portions.

With the adjoining longitudinal edges 30 and 40 of adjacent rolls 20 secured together using either of the aforementioned methods, a continuous and gapless surface 84 of the composite drainage material 20 is created on which the automotive vehicles 80 can be parked.

Figure 14:
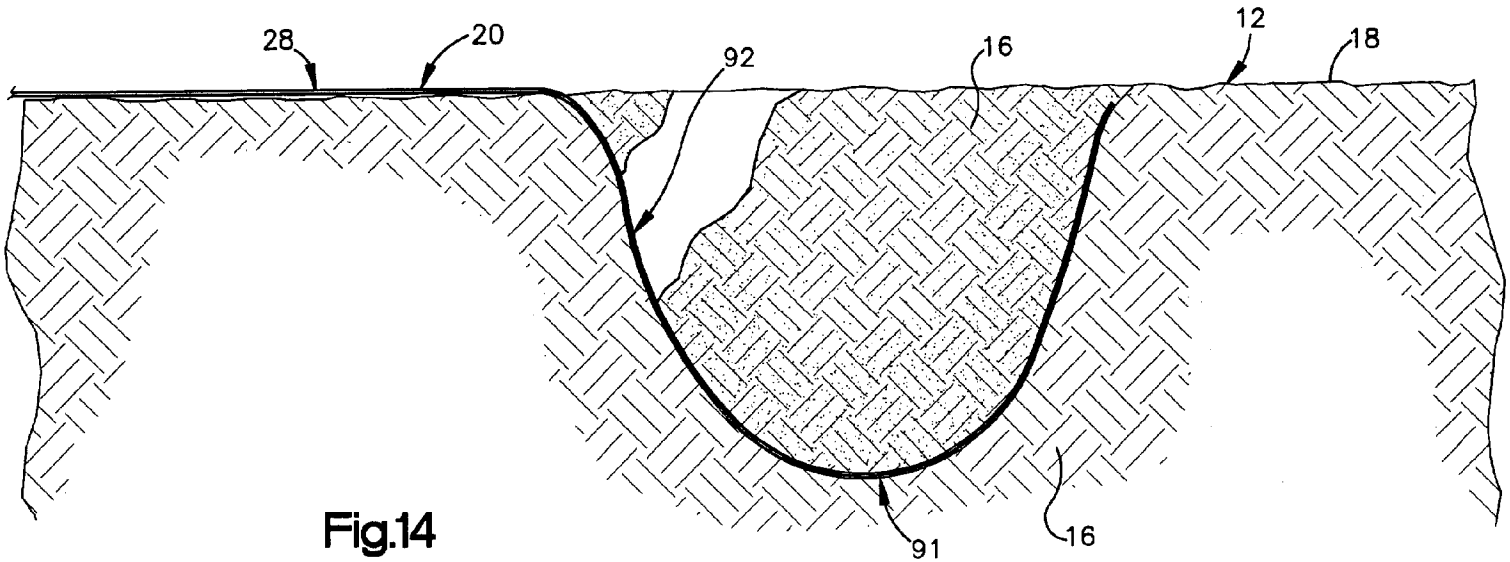
FIG. 14 is a sectional view taken along line 14—14 in FIG. 2 illustrating another aspect of the invention.

FIG. 14 is a sectional view through a portion of FIG. 2 and illustrates another step in the process for constructing the automotive parking lot 10. This step comprises anchoring peripheral sections 90 of a portion of the rolls 28 that define the outer periphery of the automotive parking lot 10 to the land area 12. The peripheral sections 90 are anchored by being buried in the land area 12. First, trenches 92, only one of which is shown in FIG. 14, are dug in the soil 16 underneath the peripheral sections 90. The trenches 92 are one to four feet wide and one to three feet deep. Next, the peripheral sections 90 are placed into the trenches 92, forming a lining inside each trench. Finally, the trenches 92 are filled with the soil 16 previously removed, covering over the peripheral sections 90 and thereby anchoring the peripheral sections to the land area 12.

Finally, to complete the automotive parking lot 10, lines 100 (FIG. 1) are painted on the surface 80 on the second fabric layer 24 of the rolls 28 of the composite drainage material 20 to indicate a plurality of parking places for the automotive vehicles 82.

As shown by the arrows in FIGS. 6, 8, 10, and 12 the composite drainage material 20 directs water, such as rain, which contacts the surface 80 through the composite drainage material and into the soil 16 of the land area 12., The water flows through the second fabric layer 26, through the core 22, and through the first fabric layer 24. The combination of the core 22 and the fabric layers 24 and 26 function to disperse the water across a large section of the land area 12 so that normal ground water flow for the land area is maintained. This dispersion of the water obviates the need for a retention pond.

The core 22 in the composite drainage material 20 provides a sufficiently hard surface for the automotive vehicles 82 to be driven on. Further, the heat fusion of the fabric layers 24 and 26 to the core 22 allows the composite drainage material 20 to withstand vehicle traffic, including turning of vehicle wheels, without the fabric layers becoming detached from the core. The geo-textile fabric of the first and second layers 24 and 26 stabilizes the soil 14 and traps the soil underneath the composite drainage material 20 to prevent large amounts of dirt and/or mud from penetrating to the upper surface 80 of the composite drainage material. Further, the continuous and gapless surface 84 formed by the overlapping junction between the adjacent rolls 28 of the composite drainage material 20 also prevents dirt and/or mud from penetrating to the surface 80 between adjacent rolls. The composite drainage material 20 is reusable and has a useful life of up to five years. Finally, the composite drainage material 20 is relatively inexpensive to manufacture and install.

Figure 15:
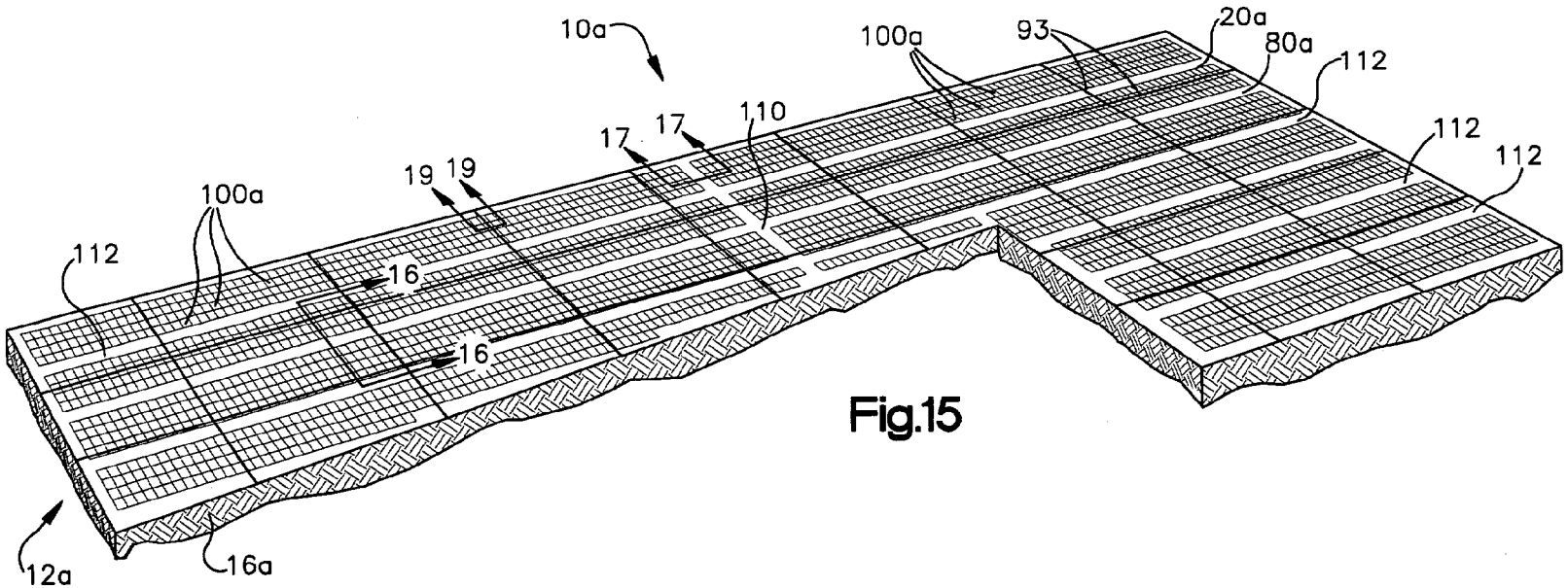
FIG. 15 is a schematic perspective view of an automotive vehicle parking lot constructed in accordance with a further embodiment of the present invention.

FIG. 15 illustrates an automotive vehicle parking lot 10*a* constructed in accordance with a further embodiment of the present invention. The parking lot 10*a* is similar to the parking lot in FIG. 1 and parts that are the same or similar are given the same reference numerals with the suffix "a" attached.

The parking lot 10*a* is situated on a relatively flat land area 12*a*. The parking lot 10*a* is made of a composite drainage material 20*a* which is identical to the composite drainage material 20 illustrated in FIG. 3 and described below.

The parking lot 10*a* is made of a plurality of rolls 28*a* of the three layer composite drainage material 20*a* that are secured together. The parking lot 10*a* in FIG. 15 includes a main drive 110 and a plurality of drive lanes 112 intersecting the main drive. The main drive 110 bisects the parking lot 10*a*. The main drive 110 and drive lanes 112 provide a navigation route for the vehicles to follow when they are parked on the parking lot.

Figure 17:
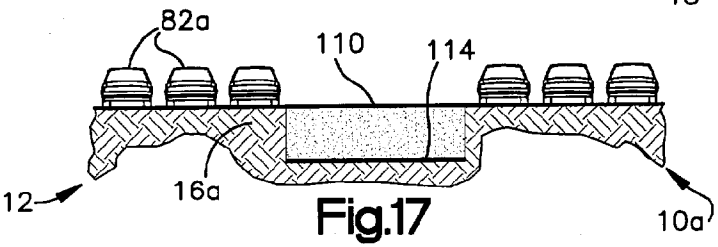
FIG. 17 is a sectional view taken along line 17—17 of FIG. 15.

Portions of the land area 12*a* underneath the area where the main drive 110 and drive lanes 112 are to be located are prepared before the rolls 28*a* of composite drainage material 20*a* are laid on the land area surface 18*a*. Referring now to FIG. 17, to prepare the land area 12*a* for the main drive 110, approximately 6–8 inches of land 16*a* are excavated over a width of approximately 22 feet to form a trench. A layer of filter material 114 comprising a non-woven geo-textile fabric identical to the first or second layer of composite drainage material 20*a* is placed in the trench. A 6 inch layer of stones or gravel is placed onto the layer of filter material 114 in the trench.

Figure 16:
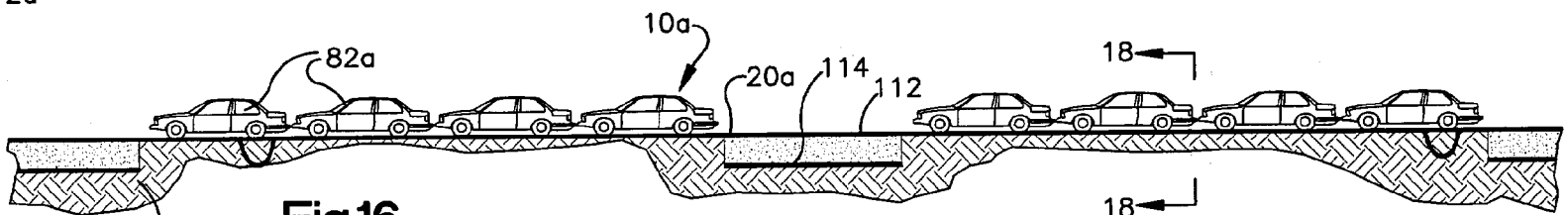
FIG. 16 is a sectional view taken along line 16—16 in FIG. 15.

Referring now to FIG. 16, to prepare the land area 12*a* for the drive lanes 112, approximately 2–4 inches of land 16*a* is excavated over a width of approximately 22 feet to form a trench. A layer of filter material 114 is placed in the trench. A 2 inch layer of stones or gravel is placed onto the layer of filter material 114 in the trench.

The land area 12*a*, underneath where the main drive 110 is to be located, is constructed to have 6 inches of gravel because this is the most heavily navigated area of the parking lot 10*a*. The gravel provides a sturdier foundation underneath the main drive 110 because the gravel and the filter material 114 act as a filter to channel water from the surface 80*a* of the parking lot 10*a* to help extend the life of the composite drainage material 200 along the main drive 110.

The land area 12*a* underneath where the drive lanes 112 are to be located is constructed to have 2 inches of gravel because this is also a heavily navigate area of the parking lot 10*a*, albeit not as heavily navigated as the main drive 110. The gravel provides a sturdier foundation underneath the drive lanes because the gravel and the filter material act as a filter to channel water from the surface 80*a* of the parking lot 10*a* to help extend the life of the composite drainage material 20*a* along the drive lanes 112.

A space of approximately 72 feet or so separates each pair of drive lanes 112 in the parking lot 10*a*. The 72 foot wide space separating each drive lane 112 is for a plurality of parking spaces 100*a* for the vehicles.

The vehicle parking lot 10*a* illustrated in FIG. 15 occupies a land area of approximately 42 acres and includes approximately 6700 parking spaces. The size of the parking lot 10*a* can vary from much smaller to much larger than these approximate measurements and are provided as an example only.

The parking lot 10*a* is constructed similar to the embodiment shown in FIGS. 1 and 2. Several rolls 28*a* (FIG. 18) of the composite drainage material 20*a* are placed on the land area 12*a* adjacent one another. The rolls 28*a* of the composite drainage material 20*a* are then unrolled, in a manner similar to as illustrated in FIG. 2, so that the first longitudinal edge 30*a* of one roll 28*a* of the composite drainage material adjoins and overlaps the second longitudinal edge 40*a* of an adjacent roll 28*a* of the composite drainage material. The first fabric layer 24*a* of each roll 28*a* of the composite drainage material 20*a* contacts the upper surface 18*a* of the land area 12*a*. The second fabric layer 26*a* of each roll 28*a* faces upward, away from the land area 12*a*, and provides a surface 80*a* on which automotive vehicles 82*a* may be parked.

Figure 18:
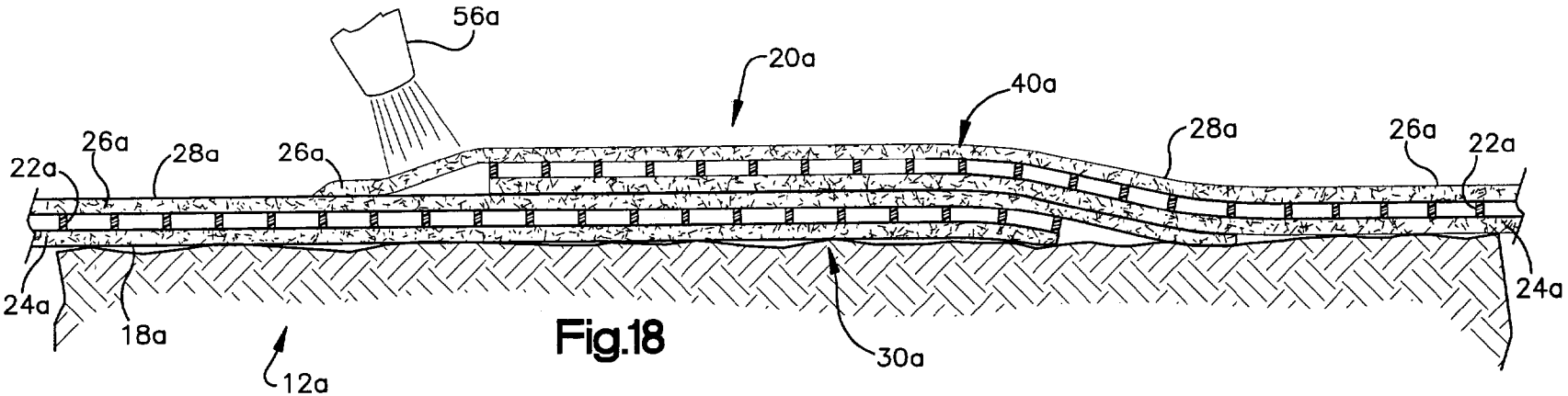
FIG. 18 is a sectional view taken along line 18—18 of FIG. 17 illustrating a step in the construction of the automotive vehicle parking lot.

The adjoining first and second longitudinal edges 30*a*, 40*a* of adjacent rolls 28*a* are unrolled so that the second longitudinal edge 40*a* overlaps the first longitudinal edge 30*a*. The rolls 28*a* are manufactured so that the second layer 26*a* extends approximately 4–6 inches farther than the core 22*a* and the first layer 24*a* to form a flap section. As best illustrated in FIG. 18, the 4–6 inch extension of the second layer 26*a* of the second longitudinal edge 40*a* is secured to the second layer 26*a* of the first longitudinal edge 30*a* by heat-fusing using a heat gun 56*a*.

The parking lot according to FIG. 15 illustrates areas of the parking lot 10*a* in bold lines 93 and in a grid pattern. The bold lines 93 schematically represent adjacent edges 30*a*, 40*a* of rolls 28*a* of the composite drainage material have been secured to each other in a manner illustrated in FIG. 19.

Figure 19:
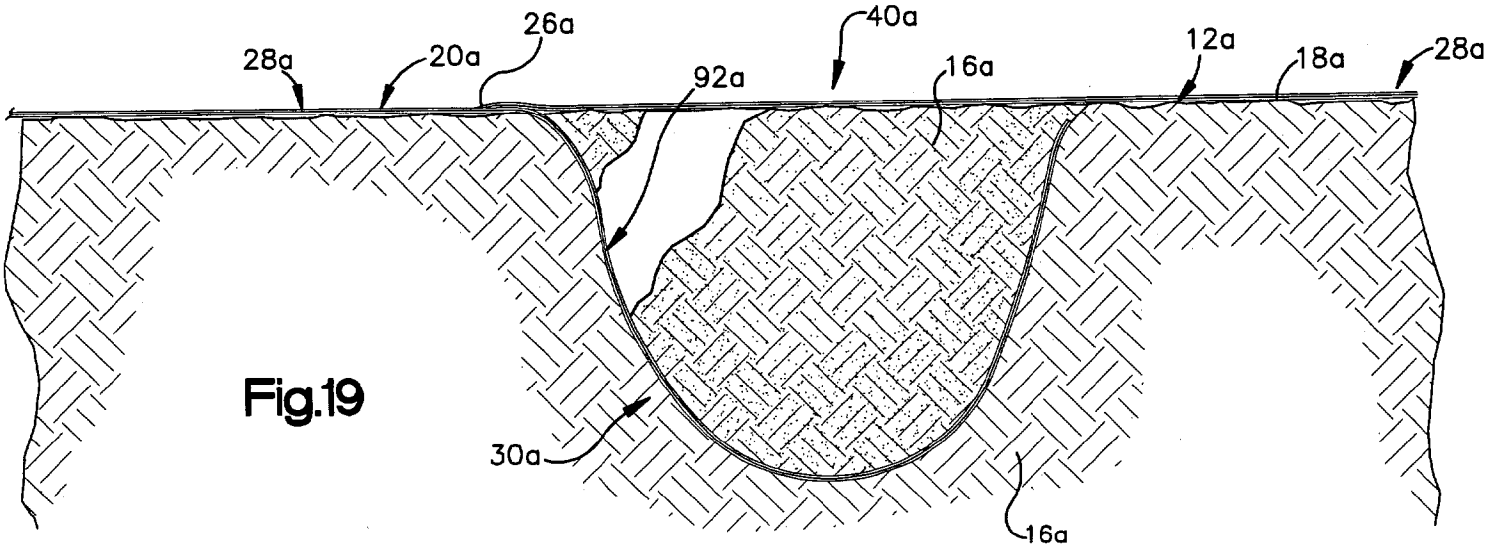
FIG. 19 is a sectional view taken along line 19—19 in FIG. 15 illustrating a step for constructing an automotive parking lot in accordance with a fifth method.

FIG. 19 is a sectional view through a portion of FIG. 15 and illustrates another step in the process for constructing the parking lot 10*a*. This step is similar to the step illustrated in FIG. 14. This step comprises excavating a portion of the land 16*a* underneath the first longitudinal edge 30*a* of a roll 28*a* of composite drainage material to form a trench 92*a*. The first longitudinal edge 30*a* of a roll 28*a* of composite drainage material 20*a* is placed into the trench and buried with the excavated land 16*a* and secured in place, or anchored, by the land 16*a*.

Next, the second longitudinal edge 40*a* of an adjacent roll 28*a* of composite drainage material 20*a* is placed over the land 16*a* and over a portion of the second layer 26*a* of a portion adjacent the first longitudinal edge 30*a* which is not buried under the land. In the same manner as illustrated in FIG. 18, the second layer 26*a* of the second longitudinal edge 40*a* is secured to the portion of the second layer 26*a* adjacent the first longitudinal edge 30*a* using the heat gun 56*a*.

Specifically, the flap section of the second layer 26*a* of the second longitudinal edge 40*a* is secured to the second layer 26*a* of the first longitudinal edge 30*a* by heat-fusing with the heat gun 56*a*.

Figure 20:
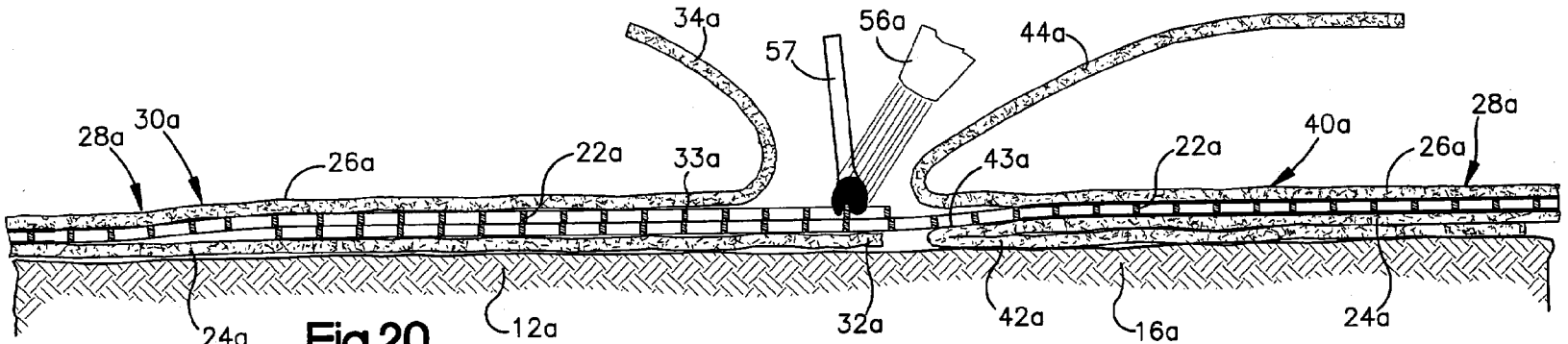
FIG. 20 is a sectional view similar to FIG. 18 illustrating a step for constructing an automotive parking lot in accordance with a sixth method.
Figure 21:
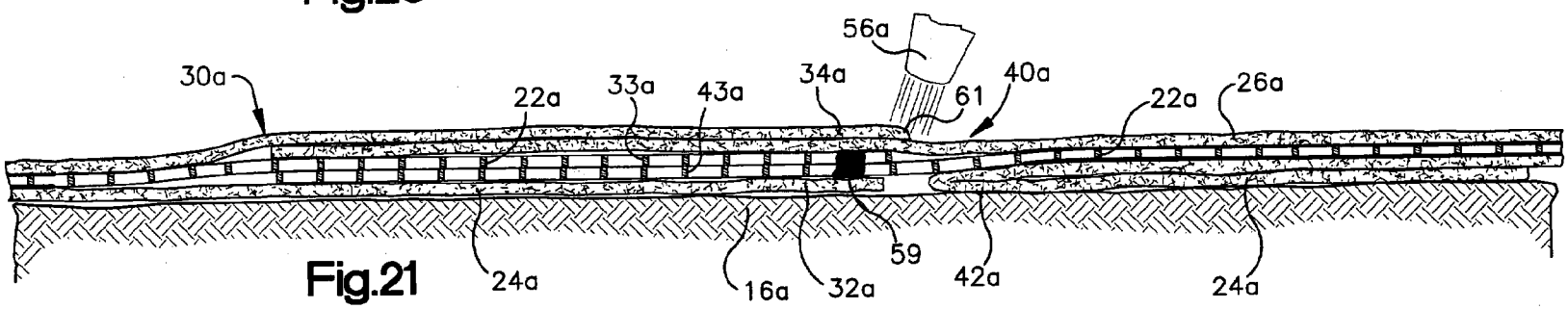
FIG. 21 is a sectional view illustrating another step for constructing the automotive parking lot in accordance with the sixth method of FIG. 20.

An alternative method for securing together adjacent longitudinal edges 30*a*, 40*a* of composite drainage material is illustrated in FIGS. 20 and 21. First, the first and second layers 24*a*, 26*a* of the second longitudinal edge 40*a* are pulled back, as shown in FIG. 20, exposing the core 22*a*. More specifically, the edge portion 42*a* of the first layer 24*a* of the second longitudinal edge 40*a* is folded back underneath itself over the land area and the edge portion 44*a* of the second layer 26*a* of the second longitudinal edge 40*a* is pulled back to expose the edge portion 43*a* of the core 22*a*. Next, the edge portion 34*a* of the second layer 26*a* of the first longitudinal edge 30*a* is pulled back as shown in FIG. 20.

Next, the edge portion 43*a* of the core 22*a* of the second longitudinal edge 40*a* is inserted between the edge portion 33*a* of the core 22*a* and the edge portion 32*a* of the first layer 24*a* of the first longitudinal edge 30*a*. As may be seen in FIG. 20, there is approximately 4 to 8 inches of overlap between the edge portions 33*a*, 43*a* of the cores 22*a*.

Next, the edge portion 43*a* of the core 22*a* of the second longitudinal edge 40*a* is secured to the edge portion 33*a* of the core 22*a* of the first longitudinal edge 30*a* by melting a portion of a polyethylene filler rod 57 over the overlapped edge portions 33*a*, 43*a* of the cores 22*a* with the heat gun 56*a*. The melted polyethylene filler rod 57 seeps into the overlapped cores 22*a* and hardens on the core 22*a* upon cooling to form a joint 59.

As best illustrated in FIG. 21, the next step is to secure the second layer 26*a* of the two adjoining rolls 28*a* to each other and form an outer seam 61 that extends along the longitudinal edges. The edge portion 44*a* of the second layer 26*a* along the second longitudinal edge 40*a* is laid down over the edge portion 33*a* of the core 22*a* of the first longitudinal edge 30*a*. The edge portion 34*a* of the second layer 26*a* along the first longitudinal edge 30*a* is then unfolded and laid down on top of the edge portion 44*a* of the second layer 26*a* of the second longitudinal edge 40*a* in an overlapping fashion.

The two second layers 26*a* are then heat-fused together to form the longitudinally extending outer seam 61 using the heat gun 56*a*. The edge portions 34*a*, 44*a* of the two second layers 26*a* are fused together near the terminal end of the edge portion 34*a* using the heat gun 56*a*. The seam 61 formed by the two second layers 26*a* extends along the entire longitudinal edge portions 30*a*, 40*a*.

Figure 22:
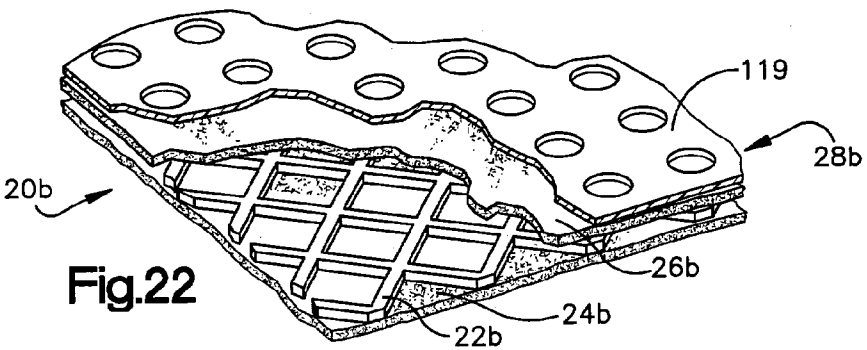
FIG. 22 is an enlarged plan view of a portion of the automotive vehicle parking lot shown in FIG. 15 during construction.

FIG. 22 illustrates a composite drainage material 20*b* used to construct the parking lot 10*a* according to the present invention. The composite drainage material 20*b* is similar to the composite drainage material 20*a* and parts that are the same or similar are given the same reference numerals with the suffix "b" attached.

The composite drainage material 20*b* comprises a polymeric open mesh core 22*b* between first and second layers 24*b* and 26*b* of a non-woven geo-textile fabric. The core 22*b* is 2–8 mm thick and is extruded from polyethylene resin. The composite drainage material 20*b* includes a fourth layer 119 on top of the second layer 26*b*.

The geo-textile fabric used for the first and second layers 24*b* and 26*b* is a continuous layer of a polypropylene material with an additive to help protect the fabric from the effects of ultraviolet light. The first and second layers 24*b* and 26*b* are water permeable, but are sufficiently dense to prevent solid matter, such as soil, from penetrating through the layers. Each of the first and second layers 24*b* and 26*b* is 2–8 mm thick.

In the composite drainage material 20*b* according to FIG. 22, the polyethylene core 22*b* is placed between the first and second layers 24*b*, 26*b* and the fourth layer 119 is placed on top of the second layer 26*b* and the composite drainage material 20*b* is fused to the second layer using a heating process. The heating process fuses both the fourth layer 119 to the second layer 26*b* of fabric and fuses the first and second layers 24*b*, 26*b* of the fabric to the core 22*b* to create the composite drainage material 20*b*. While central portions (constituting the vast majority) of the first and second layers 24*b* and 26*b* are fused to the core 22*b*, along the outer periphery of the composite drainage material 20*b*, so that the fourth layer 119 includes a flap section of approximately 4–6 inches in length. The fourth layer 119 is not fused to the second layer 26*b*.

Similar to the core layer 22*b*, the fourth layer 119 is extruded from polyethylene resin and is 2–8 mm thick. The fourth layer 119 is shown in FIG. 22 as a solid piece of polyethylene resin with circular holes. However, the fourth layer 119 is schematically illustrated only in FIG. 22 and can have any similar construction such as a lattice design.

Figure 23:
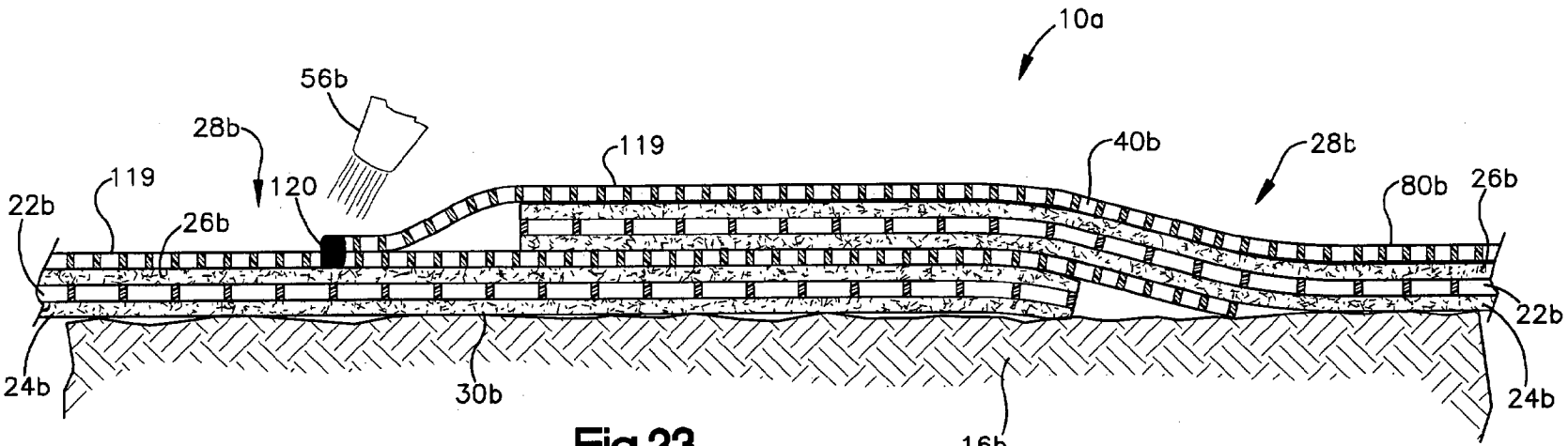
FIG. 23 is a sectional view similar to FIG. 18 illustrating a step for constructing an automotive parking lot shown in accordance with the fifth method of FIG. 19.

The parking lot of FIG. 15 can alternatively be constructed using the composite drainage material 20*b* of FIG. 22. FIG. 23 illustrates a method of securing two overlapping edges of two adjacent rolls of composite drainage material of 20*b* while constructing the parking lot 10*a*.

Several rolls 28*b* of the composite drainage material 20*b* are placed on the land area 16*b* adjacent one another. The rolls 28*b* of the composite drainage material 20*b* are then unrolled, in a manner similar to as illustrated in FIG. 23, so that the first longitudinal edge 30*b* of one roll 28*b* of the composite drainage material 20*b* adjoins and overlaps, the second longitudinal edge 40*b* of an adjacent roll 28*b* of the composite drainage material. The first fabric layer 24*b* contacts the upper surface of the land area 16*b*. The fourth layer 119 of each roll 28*b* faces upward, away from the land area 16*b*, and provides a surface 80*b* on which automotive vehicles may be parked.

The adjoining first and second longitudinal edges 30*b* and 40*b* of adjacent rolls 28*b* are unrolled so that the second longitudinal edge 40*b* overlaps the first longitudinal edge 30*b*. The flap section of the fourth layer 119 of the second longitudinal edge 40*b* is secured to the fourth layer 119 of the first longitudinal edge 30*b* by heat-fusing using the heat gun 56*b*. Heat-fusing the fourth layers 119 of the first and second longitudinal edges 40*b*, 30*b*, melts the polyethylene resin of each of the fourth layers 119 onto each other to form a seam 120.

The method of heat-fusing the fourth layers 119 of the first and second longitudinal edges 30*b*, 40*b* of two adjacent rolls 28*b* of the composite drainage material 20*b* according to FIG. 23, provides a secure connection since the melted polyethylene resin from each layer 119 of overlapping fourth layers 119 binds the two layers 119 together when cooled.

The composite drainage material 20*b* also advantageously provides a sturdier surface for the vehicles 82 when navigating in the parking lot 10*a* and can make navigation easier on the parking lot 10*a* during inclement weather conditions.

From the above description of the invention, those skilled in the art will perceive improvements, changes and modifications. Such improvements, changes and modifications within the skill of the art are intended to be covered by the appended claims.

Having described the invention, the following is claimed:

1. A method of constructing an automotive vehicle parking lot on a land area, said method comprising the steps of:

providing a composite drainage material through which water drains, the composite drainage material including a polymeric open mesh core between upper and lower layers of a non-woven geo-textile fabric;

covering the land area with the composite drainage material by placing rolls of the composite drainage material adjacent one another, said step of covering the land area with the composite drainage material includes unrolling the rolls of the composite drainage material over the land area and positioning longitudinal edge portions of adjacent rolls in alignment with each other and with lower layers of non-woven geo-textile fabric engaging the land area, said step of positioning longitudinal edge portions of adjacent rolls in alignment with each other includes positioning a longitudinal edge portion of the open mesh core of a first roll of composite drainage material in an overlapping relationship with a longitudinal edge portion of the open mesh core of a second roll of composite drainage material, securing the longitudinal edge portions of adjacent rolls of composite drainage material to each other, said step of securing the longitudinal edge portions of adjacent rolls of composite drainage material includes heat fusing an upper layer of non-woven geo-textile fabric of one of the first and second rolls of composite drainage material to an upper layer of non-woven geo-textile fabric of another of the first and second rolls of composite drainage material while the open mesh core of the first roll of composite drainage material is in an overlapping relationship with the open mesh core of the second roll of composite drainage material to create a gapless and continuous surface of the composite drainage material with at least the majority of the land area lying underneath the composite drainage material, the lower layer of non-woven geo-textile fabric of each of the rolls contacting the land area, the upper layer of the non-woven geo-textile fabric of each of the rolls facing away from the land area and providing a gapless and continuous surface on which automotive vehicles are parked; and folding an edge portion of a first lower layer of non-woven geo-textile fabric back underneath itself so that the folded back edge portion of the first lower layer of non-woven geo-textile fabric is disposed between a portion of the first lower layer of non-woven geo-textile fabric and the land area;

the composite drainage material conducting water through the upper layer of non-woven geo-textile fabric, through the core between the upper and lower layers, and through the lower layer of non-woven geo-textile fabric to the land area covered by the composite drainage material to drain water from the gapless and continuous surface on which automotive vehicles are parked.

2. A method as set forth in claim 1 wherein said step of positioning the open mesh core of the first roll of composite drainage material in an overlapping relationship with the open mesh core of the second roll of composite drainage material includes positioning the open mesh cores in engagement with each other and looping a tie member through the open mesh cores without looping the tie member through an upper layer of non-woven geo-textile fabric and without looping the tie member through a lower layer of a non-woven geo-textile fabric.

3. A method as set forth in claim 1 wherein said step of positioning the open mesh core of the first roll of composite drainage material in an overlapping relationship with the second roll of composite drainage material includes positioning the open mesh cores in engagement with each other and includes heating a polymeric material to enable the polymeric material to flow over portions of the open mesh cores of the first and second rolls and to harden over the portions of the open mesh cores of the first and second rolls.

4. A method as set forth in claim 1 wherein said step of securing longitudinal edge portions of adjacent rolls includes connecting the open mesh core of the first roll to the open mesh core of the second roll before performing said step of fusing an upper layer of non-woven geo-textile fabric of one of the first and second rolls of composite drainage material to an upper layer of non-woven geo-textile fabric of another of the first and second rolls.

5. A method as set forth in claim 1 wherein said step of securing the longitudinal edge portions of adjacent rolls to each other includes sewing the upper layer of non-woven geo-textile fabric of the one of the first and second rolls of composite drainage material to the upper layer of non-woven geo-textile fabric of the other of the first and second rolls of composite drainage material at a location which is spaced from the peripheral edge portion of the upper layer of non-woven geo-textile fabric of the one of the first and second rolls of composite drainage material.

6. A method as set forth in claim 1 wherein said step of securing the longitudinal edge portions of adjacent rolls of composite drainage material includes forming a butt joint between the upper layer of non-woven geo-textile fabric of the one of the first and second rolls of composite drainage material and the upper layer of a non-woven geo-textile fabric of the other of the first and second rolls of composite drainage material by positioning edges of the upper layers of non-woven geo-textile fabric in abutting engagement, said step of heat fusing upper layers of non-woven geo-textile fabric includes heat fusing the upper layers of non-woven geo-textile fabric at the butt joint.

7. A method as set forth in claim 1 wherein said step of positioning the longitudinal edge portion of the open mesh core of the first roll of composite drainage material in an overlapping relationship with a longitudinal edge portion of the open mesh core of the second roll of composite drainage material includes positioning longitudinal edge portions of the open mesh cores in overlapping engagement.

8. A method as set forth in claim 1 further including the steps of anchoring a portion of the rolls of composite drainage material to the land area by burying the portions of the rolls of composite drainage material under ground.

9. A method as set forth in claim 1 further including the steps of digging trenches in the land area, placing portions of the composite drainage material into the trenches so that the composite drainage material forms a lining inside the trenches, and filling the trenches lined by the composite drainage to thereby anchor the composite drainage material to the land area.

* * * * *